US010546542B1

(12) United States Patent
Lee et al.

(10) Patent No.: US 10,546,542 B1
(45) Date of Patent: Jan. 28, 2020

(54) DISPLAY BRIGHTNESS ADJUSTING METHOD, DISPLAY BRIGHTNESS ADJUSTING DEVICE, AND DISPLAY APPARATUS THEREOF

(71) Applicant: HON HAI PRECISION INDUSTRY CO., LTD., New Taipei (TW)

(72) Inventors: Kuo-Sheng Lee, New Taipei (TW); Po-Fu Chen, New Taipei (TW); Chih-Hao Chang, New Taipei (TW)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 16/124,503

(22) Filed: Sep. 7, 2018

(30) Foreign Application Priority Data

Jul. 6, 2018 (CN) ..... 2018 1 0744323

(51) Int. Cl.
*G09G 3/34* (2006.01)

(52) U.S. Cl.
CPC ... *G09G 3/3406* (2013.01); *G09G 2320/0233* (2013.01); *G09G 2320/0673* (2013.01); *G09G 2360/14* (2013.01); *G09G 2360/16* (2013.01)

(58) Field of Classification Search
CPC .. G09G 3/2092; G09G 3/3291; G09G 3/3406; G09G 2320/0233; G09G 2360/16; G09G 2360/14; G09G 2320/0673; G09G 3/001; G09G 3/20; G09G 3/3611; G09G 5/005; G06T 5/001
See application file for complete search history.

(56) References Cited

U.S. PATENT DOCUMENTS

2005/0212736 A1* 9/2005 Lu ..... G09G 3/3611 345/87
2009/0213055 A1* 8/2009 Chung ..... G09G 3/20 345/89
2013/0083087 A1 4/2013 Byun et al.
2013/0120659 A1* 5/2013 Park ..... G06T 5/001 348/674
2014/0267456 A1* 9/2014 Ando ..... G09G 3/001 345/690
2014/0313235 A1* 10/2014 Park ..... G09G 3/3291 345/690
2015/0154908 A1 6/2015 Nam et al.
2017/0206825 A1* 7/2017 Cha ..... G09G 3/2092
2018/0261184 A1* 9/2018 Ninan ..... G09G 5/005

FOREIGN PATENT DOCUMENTS

CN 103035196 A 4/2013
CN 104700772 A 6/2015

* cited by examiner

*Primary Examiner* — Richard J Hong
(74) *Attorney, Agent, or Firm* — ScienBiziP, P.C.

(57) ABSTRACT

A display brightness adjusting method includes detecting a brightness of individual pixel regions of a display apparatus to acquire grayscale values. The brightness distribution information is analyzed to acquire a first compensation value to be applied to each pixel region and a first gamma voltage based on the first compensation value is calculated and applied. The uniformity of brightness of each pixel region is improved.

17 Claims, 5 Drawing Sheets

DISPLAY BRIGHTNESS ADJUSTING METHOD, DISPLAY BRIGHTNESS ADJUSTING DEVICE, AND DISPLAY APPARATUS THEREOF

FIELD

The present disclosure relates to displays.

BACKGROUND

Display apparatuses display images based on light emitted by a backlight module. The light emitting diode (LED) backlight module, as an example, includes a back plate, a light source, a light guiding plate, and at least one optical film. The light source is LEDs. The LEDs as dot light sources are disposed on the back plate, and are distanced from each other to form an LED matrix. The light from the LEDs are mixed at a light emitting surface, and the mixed light is emitted to the display apparatus. The brightness of the light emitted by the backlight module is related to a distance between the light source and the light emitting surface. The distance between the light source and a light emitting surface can be decreased due to a thinner requirement of the display apparatus, which causes the brightness of light to be non-uniform. A brightness of the position facing the light source is greater than a brightness of the position facing a space between the LEDs. Thus, there is room for improvement in the art.

BRIEF DESCRIPTION OF THE FIGURES

Implementations of the present technology will now be described, by way of example only, with reference to the attached figures.

DETAILED DESCRIPTION

Figure 1:
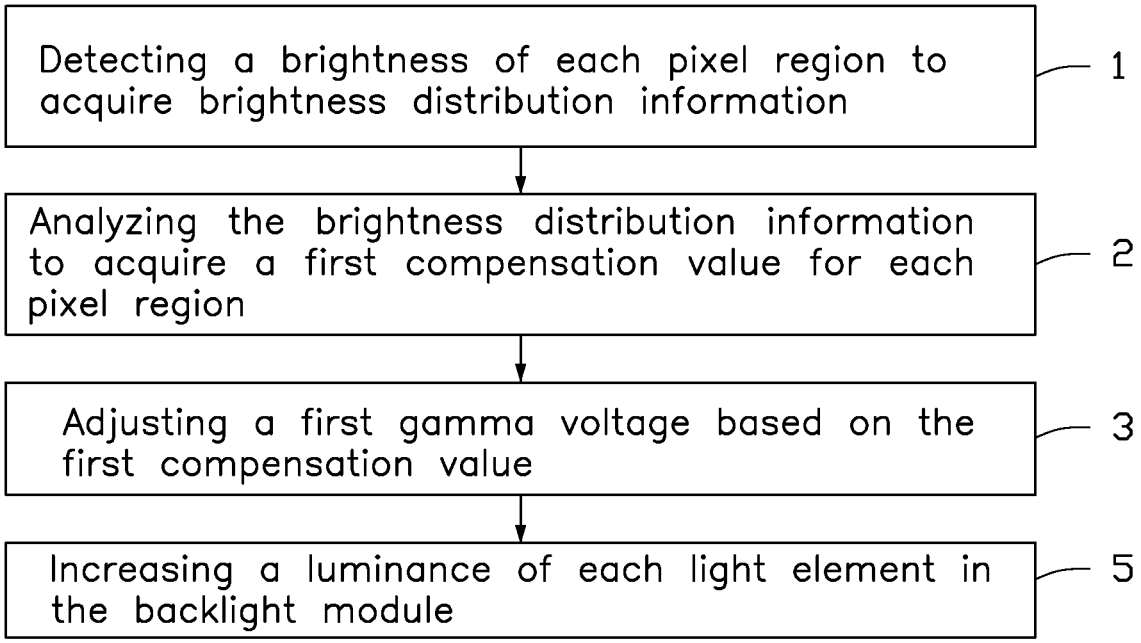
FIG. 1 is a flowchart of a display brightness adjusting method of a first embodiment.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. The drawings are not necessarily to scale and the proportions of certain parts may be exaggerated to better illustrate details and features. The description is not to be considered as limiting the scope of the embodiments described herein.

The term "comprising" means "including, but not necessarily limited to"; it specifically indicates open-ended inclusion or membership in a so-described combination, group, series, and the like. The disclosure is illustrated by way of example and not by way of limitation in the figures of the accompanying drawings in which like references indicate similar elements. It should be noted that references to "an" or "one" embodiment in this disclosure are not necessarily to the same embodiment, and such references can mean "at least one."

The present disclosure relates to a display brightness adjusting method for improving uniformity of brightness of the light emitted by a backlight module. In related art, a display apparatus includes a backlight module as a light source and a display module for display images based on the light from the backlight module.

First Embodiment

In a first embodiment, a principle of an operation of the display apparatus is described as below. In related art, the display apparatus uses the light emitted by the backlight module for displaying images. The display apparatus includes a plurality of pixel regions. Liquid crystals of a liquid crystal layer rotate different angles based on different voltages, and a transmittance of the light emitted by the backlight module through the liquid crystal layer is related to a rotated angle of the liquid crystals. The less the liquid crystal layer blocks light, the higher the brightness of the pixel. Thus, the voltage applied to the pixel region is used for controlling the rotating angle of the liquid crystal facing the pixel region, and the different transmittances of the pixel regions control the brightness of the pixel regions, thus the display apparatus displays different images.

For improving performance of the display apparatus, the light of the backlight module applied to the display apparatus needs to be made more uniform. The uniformity of brightness of the display apparatus cannot be achieved based only on the structure design of the display apparatus in the background.

FIG. 1 illustrates a display brightness adjusting method. The display brightness adjusting method may comprise at least the following steps, which also may be re-ordered where necessary:

Step 1, detecting a brightness of each pixel region to acquire brightness distribution information of each pixel region.

Step 2, analyzing the brightness distribution information to acquire a first compensation value for each pixel region.

Step 3, adjusting a first gamma voltage based on the first compensation value for improving a brightness uniformity of each pixel region.

In the present disclosure, the display apparatus includes a plurality of pixel regions. A brightness of each pixel region is detected. In first embodiment, each pixel region includes a plurality of pixels. In other embodiments, each pixel region includes one pixel. By comparing the brightness of pixel regions with the brightness of pluralities of pixels, the brightness distribution information is more accurate, and the display brightness adjusting method is also more accurate. When the number of pixels being detected is reduced, the number of calculations that the display brightness adjusting method must do is also reduced. Thus, due to a low display requirement of the display apparatus, the pixel region with the plurality of pixels is a more satisfied structure of the display apparatus. In the first embodiment, the brightness detecting operation for each pixel region is executed by an image sensor, such as a CCD, but is not limited thereto.

In other embodiments, a grayscale represents the detected brightness of each pixel region, and the detected grayscale of each pixel region serves as the brightness distribution information.

In the first embodiment, the grayscale is preferably detected based on the display of a white image.

Figure 2:
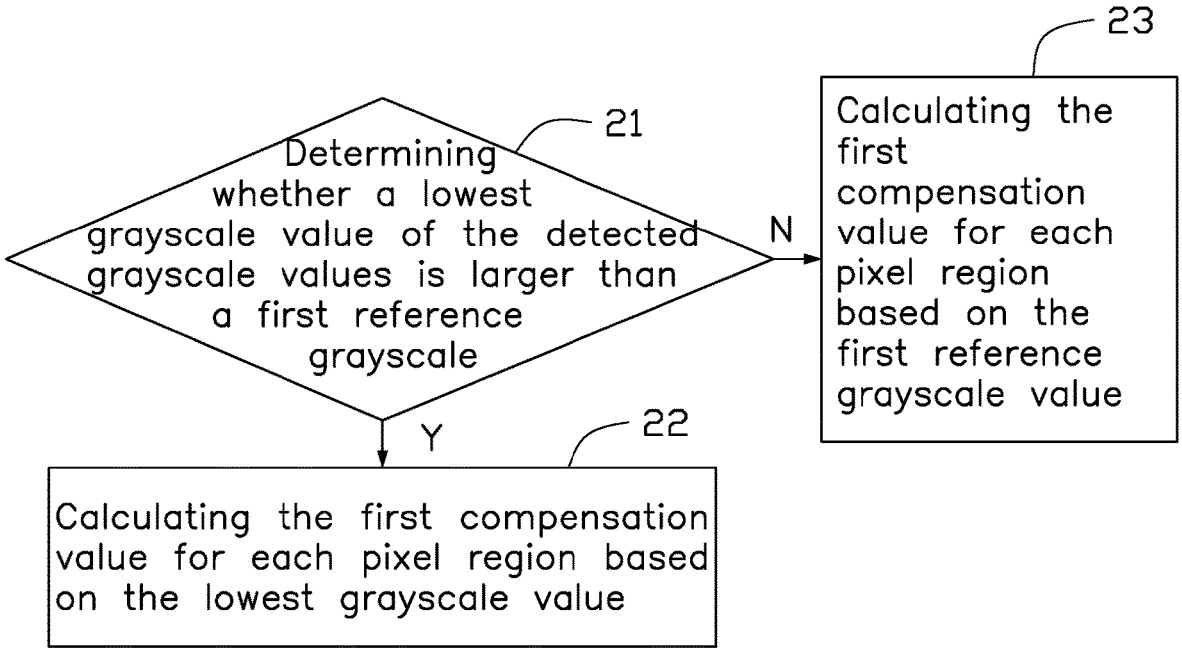
FIG. 2 is a detail view of the step S2 of the flowchart of FIG. 1.

Further, the first compensation value for each pixel region is calculated based on the operation of analyzing the detected grayscale of each pixel region. In the first embodiment, as shown in FIG. 2, the step of analyzing the brightness distribution information to acquire a first compensation value for each pixel region further comprises:

Step 21, determining whether the lowest grayscale value of the detected grayscale values is less than or larger than a first reference grayscale.

Step 22, when the lowest grayscale value of the detected grayscale values is larger than the first reference grayscale, calculating the first compensation value for each pixel region based on the lowest grayscale value, the first compensation value comprising a difference between the lowest grayscale value and each detected grayscale values as the first compensation value for each pixel region.

Step 23, when the lowest grayscale value of the detected grayscale values is less than the first reference grayscale, calculating the first compensation value for each pixel region based on the first reference grayscale, the first compensation value comprising a difference between the lowest grayscale value and each detected grayscale values as the first compensation value for each pixel region.

In the first embodiment, the first reference grayscale is a lowest grayscale value of the display apparatus which is acceptable for meeting a display requirement.

As described above, the detecting operation is implemented when the display of images is based on the white image display by the display apparatus. When displaying the white image, the transmittance of each pixel region is constant, and is the same as highest possible value of transmittance. Thus, for improving the brightness uniformity of the display apparatus, the brightness of the pixel region with a highest detected brightness is adjusted to be equal to the lowest detected grayscale value.

The lower the grayscale value, the worse is the performance of the display apparatus. The value of the grayscale needs to meet an acceptable display requirement of the display apparatus Thus, for ensuring the performance of the display apparatus, the first reference grayscale represents the highest grayscale values for meeting the acceptable display requirements of the display apparatus. The first reference grayscale can be adjusted or redefined as required.

At the step 21, determining whether a lowest grayscale value of the detected grayscale values is larger than the first reference grayscale.

When the lowest grayscale value is larger than the first reference grayscale, the lowest grayscale value satisfies the display requirement of the display apparatus and the step 22 is implemented. If the lowest grayscale value is less than the first reference grayscale, the lowest grayscale value does not satisfy the display requirement of the display apparatus and the step 23 is implemented.

As an example, the display apparatus includes five pixel regions, and the first reference grayscale is 180. While displaying the white image, a brightness of each pixel region is detected, and the detected grayscale values of the pixel regions are 200, 210, 220, 230, and 250. The lowest grayscale value is 200, which is larger than the first reference grayscale (180). The lowest grayscale value thus satisfies the display requirement of the display apparatus, and step 22 is implemented. The other grayscale values of the pixel regions are adjusted to be equal to the lowest grayscale value. That is, the first compensation value for each pixel region is calculated based the difference between the detected grayscale value and the lowest grayscale value. The first compensation value is stored in storage of the display apparatus, and is used for setting a first gamma voltage as a compensation value for the pixel region as a source driver drives the pixel region. Thus, the grayscale values of the pixel regions are rendered equal, and the brightness of the display apparatus is made uniform.

In other embodiments, the display apparatus includes five pixel regions, and the first reference grayscale is 180. While displaying the white image, a brightness of each pixel region is detected, and the detected grayscale values of the pixel regions are 150, 190, 210, 230, and 255. The lowest grayscale value is 150, which is less than the first reference grayscale (180). The lowest grayscale value does not satisfy the display requirement of the display apparatus, and step 23 is implemented. The other grayscale values of the pixel regions are adjusted to be equal to the first reference grayscale. Thus, the grayscales of the pixel regions are rendered equal, and the brightness of the display apparatus is made uniform.

It can be understood that, the lowest grayscale value of the pixel region, which is less than the first reference grayscale, remains at original grayscale value. When, the difference between the adjusted grayscale value of the pixel region at the first reference grayscale and the detected grayscale value of the other pixel regions below the first reference grayscale is less than the difference between the highest detected grayscale value of the pixel region and the lowest detected grayscale value of the pixel region. By comparison with the original brightness, the uniformity of brightness of the light of the display apparatus is also improved.

Furthermore, the first compensation value acquired by the step 3 is used for adjusting a first gamma voltage of each pixel region. The first gamma voltage is related to the transmittance of the pixel region. Adjustment of the first gamma voltage results in a transmittance of a low-brightness pixel region being increased, and the transmittance of a high-brightness pixel region being decreased. Thus, the brightness uniformity of the display apparatus is improved.

Figure 3:
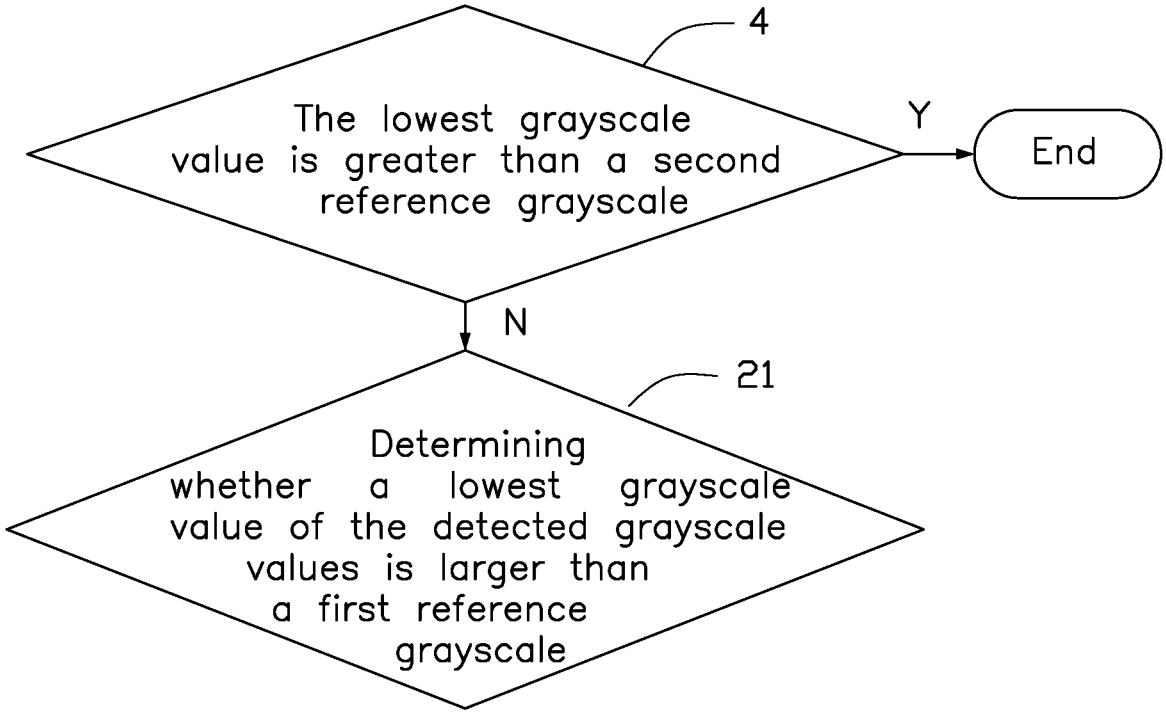
FIG. 3 is a view of the step 4 before the step 2 of FIG. 2.

In a first preferred manner, a second reference grayscale is defined. As shown in FIG. 3, before the step 21, the display brightness adjusting method further comprises:

Step 4, determining whether the lowest grayscale value is greater than the second reference grayscale. If the lowest grayscale value is larger than the second reference grayscale, the procedure ends. If the lowest grayscale value is less than the second reference grayscale, the step 21 is implemented.

In detail, the second reference grayscale is a grayscale value close to a highest grayscale value of the display apparatus. The second reference grayscale is larger than the first reference grayscale. For example, the highest grayscale value of the display apparatus can be 256, the second reference grayscale can be 200. The display apparatus includes five pixel regions. When the display of the white image, a brightness of each pixel region is detected, and the detected grayscale values of the pixel regions are 220, 230, 240, 250, and 255. The lowest grayscale value is 220, which is larger than the second reference grayscale. Under this situation, the higher the grayscale value, the less the human eye can feel the difference between a grayscale value larger than the second reference grayscale and the second reference grayscale itself. Thus, the brightness difference between the pixel regions with above grayscales is not easily identified by human eyes, and the brightness of the display apparatus can be considered as uniform. Therefore, the first gamma voltage of each pixel region is not adjusted, and the step 3 is not implemented.

Such uniformity of brightness of the light of the display apparatus also satisfies the display requirement. The brightness of the display apparatus is certainly non-uniform, but such non-uniform brightness cannot be identified by the human eyes. Therefore, where the lowest grayscale value is larger than the second reference voltage, the operation of adjusting the first gamma voltage is omitted, and an amount of the method is reduced.

If the lowest grayscale value is less than the second reference grayscale, the step 21 is implemented.

In a second preferred manner, the display apparatus includes a first grayscale set and a second grayscale set. The grayscale values in the first grayscale set and the second grayscale set are continuous. A highest grayscale value of the first grayscale set is a value of 1 (one) less than a lowest grayscale value of the second grayscale set.

In one embodiment, the adjusted first gamma voltage by the first compensation value is considered as a second gamma voltage. The brightness of the pixel regions is adjusted based on the second gamma voltage.

The first gamma voltage corresponds to one grayscale value in the first grayscale set, and the second gamma voltage corresponds to one grayscale value in the second grayscale set.

In detail, the number of the grayscale values of the display apparatus is 512. The grayscale values in a range from 0 to 256 as the first grayscale set are used for driving the display apparatus to display. The grayscale value of 256 corresponds to a specified transmittance A, and the transmittance of the pixel regions changes in a range from 0 to A. The grayscale values in a range from 257 to 512 as the second grayscale set corresponding to a transmittance range from A to 1 are used for compensating for the brightness of the pixel region. 1 represents a 100% transmittance of the pixel region.

For example, the display apparatus includes five pixel regions. As the display apparatus is displaying a white image, a brightness of each pixel region is detected, and the detected grayscale values of the pixel regions are 200, 210, 220, 230, and 250. The adjusted transmittance of the pixel region with a lower grayscale value is in the transmittance range from A to 1 for improving the uniformity brightness uniformity of the display apparatus. In detail, the first compensation value is used for adjusting the first gamma voltage to the second gamma voltage, and the second gamma voltage controls the transmittance of each pixel region.

The first compensation value is stored in storage of the display apparatus, and is used for applying compensation to the first gamma voltage of the corresponding pixel region when a source driver is driving the corresponding pixel region. Thus, the grayscale values of the pixel regions are equal, and the brightness of the display apparatus is uniform.

After the step 3, the display brightness adjusting method further comprises:

Step 5, increasing a luminance of each light element in the backlight module when the lowest grayscale value is less than the second reference grayscale.

If the lowest grayscale value is less than the second reference grayscale, the adjusted uniformed brightness of the display apparatus does not satisfy the display requirement, and the luminance of each light element in the backlight module is increased for improving the brightness of the display apparatus. Thus, both the brightness uniformity and the brightness of the display apparatus are improved.

The display brightness adjusting method acquires the first compensation value based on the brightness distribution information, and adjusts the first gamma voltage based on the first compensation value for adjusting the brightness uniformity of each pixel region. Thus, a performance of the display apparatus is improved, and the problems of the non-uniform brightness in the related art caused by the designed structure of the display apparatus are avoided.

Second Embodiment

The second embodiment provides a display brightness adjusting method. The difference between the display brightness adjusting method of the second embodiment and the display brightness adjusting method of the first embodiment is that the color uniformity of the display apparatus is also improved.

When the backlight module emits a colored light, the colored light needs to be converted before being emitted to the pixel region. As an example, when the color light is blue light, the blue light may be converted into white light by a light conversion film at the emitting surface. A conversion efficiency of the light applied to edges of the pixel region is lower than the conversion efficiency of the light applied to a center of the pixel region, thus the light applied to the edges of the pixel region is inclined to being blue light, and the color of the display apparatus is non-uniform.

Each pixel includes a plurality of sub-pixels for displaying different color light. Each pixel emits different color based on the grayscale value of each sub-pixel. In one embodiment, the sub-pixels in each pixel region include a red sub-pixel, a green sub-pixel, and a blue sub-pixel.

Figure 4:
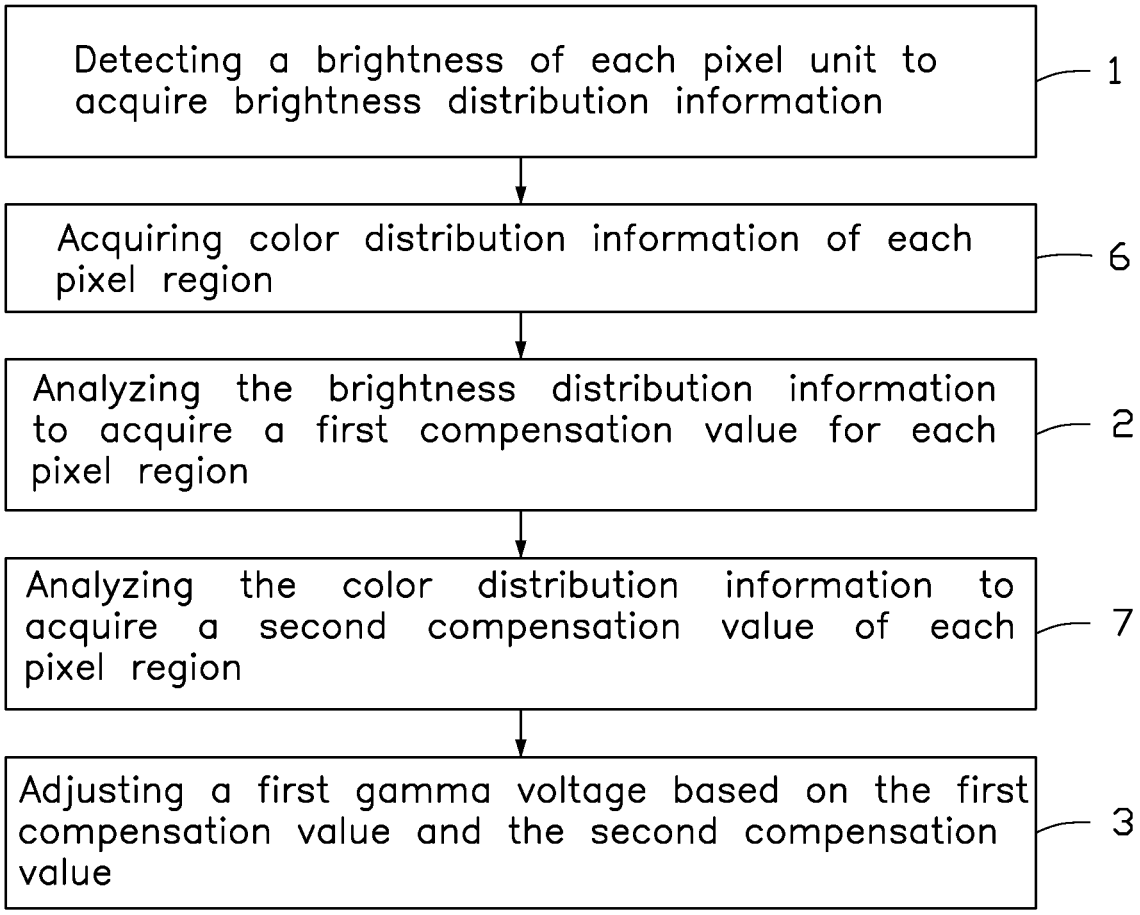
FIG. 4 is a flowchart of a display brightness adjusting method of a second embodiment.

FIG. 4 illustrates a second embodiment of the display brightness adjusting method. By comparing with the first embodiment, after the step 1, the display brightness adjusting method of the second embodiment further comprises:

Step 6, acquiring color distribution information of each pixel region of the display apparatus.

After the step 2, the display brightness adjusting method of the second embodiment further comprises:

Step 7, analyzing the color distribution information to acquire a second compensation value for each pixel region.

The first gamma voltage of the step 3 is adjusted based on the first compensation value and the second compensation value for improving a brightness and color uniformity of each pixel region.

In the second embodiment, both the brightness and the color of each pixel region are detected. The detecting operation of the color of each pixel region is executed by an image sensor, such as CCD, but is not limited thereto. In the second embodiment, a color coordinate serves as the color distribution information of each pixel region. In the second embodiment, the color coordinate of each sub-pixel is the grayscale value of each sub-pixel. The color distribution information is preferably detected based on a white image displayed by the display apparatus for improving a precision of the detecting operation.

In detail, the display apparatus includes five pixel regions, and the first reference grayscale is 180. As the display apparatus is displaying the white image, a brightness of each blue sub-pixel region is detected, and the detected grayscale values of the blue sub-pixels of the pixel regions are 170, 190, 210, 230, and 255. The blue sub-pixel with a higher grayscale value is more inclined to be blue than the blue sub-pixel having a lower grayscale value. The grayscale values of each blue sub-pixel needs to be adjusted to the lowest grayscale value of the blue sub-pixel, thus the image displayed by the display apparatus can be more inclined to being white.

If the lowest grayscale value is less than the second reference grayscale, the grayscale value of the other blue sub-pixel is adjusted to be equal to the second reference grayscale. In the second embodiment, the lowest grayscale value is 170, and the second reference grayscale is 180. The difference between the second reference grayscale and each detected grayscale value serves as the second compensation value. The second compensation value is stored in storage of the display apparatus, and cooperates with the first compensation value for compensating the first gamma voltage of the corresponding sub-pixel of the pixel region when a source driver is driving the corresponding sub-pixel of the pixel region. Thus, the grayscale values of the pixel regions are equal, and the brightness of the display apparatus is uniform.

If the lowest grayscale value is larger than the second reference grayscale, the grayscale value of the other blue sub-pixel is adjusted to be equal to the lowest grayscale value. For example, the lowest grayscale value is 200, which is larger than the second reference grayscale. Thus, the grayscale values of the blue sub-pixels of the pixel regions are 200. Differences in luminosities of grayscale values which are greater than the second reference grayscale are not identifiable by human eyes.

In another manner, the number of the grayscale values of the display apparatus is 512. The grayscale values from 0-256 are used for driving the display apparatus to display. The grayscale value at 256 corresponds to a specified transmittance A, and the transmittance of the pixel regions changes in a range from 0 to A. The grayscale values in a range from 257 to 512 corresponding to a transmittance range from A to 1 are used for compensating the brightness of the pixel region. The adjusting manner in the second embodiment is same as the adjusting manner in the first embodiment.

The display brightness adjusting method can adjust the brightness uniformity and the color uniformity of the display apparatus. Thus, the performance of the display apparatus is improved, and problems of the non-uniform brightness in the related art caused by the designed structure of the display apparatus are avoided.

The display brightness adjusting method described as above can be used in the display apparatus with a direct type backlight module.

Third Embodiment

Figure 5:
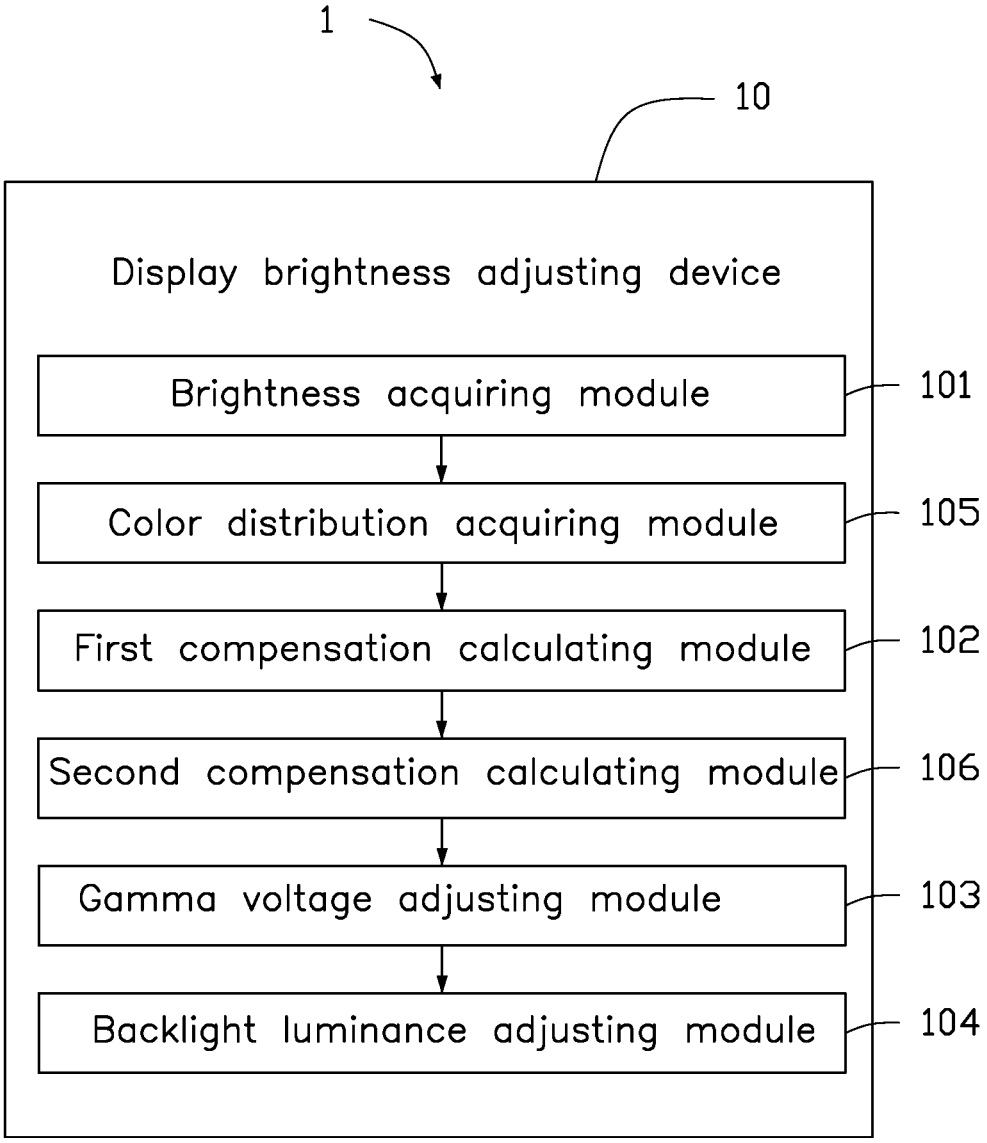
FIG. 5 is a display brightness adjusting device.

FIG. 5 illustrates a display brightness adjusting device 10 in the display apparatus. The display brightness adjusting device 10 includes a brightness acquiring module 101, a first compensation calculating module 102, and a gamma voltage adjusting module 103.

The brightness acquiring module 101 detects a brightness of each pixel region of the display apparatus to acquire brightness distribution information of each pixel region.

The first compensation calculating module 102 analyzes the brightness distribution information to acquire a first compensation value for each pixel region.

The gamma voltage adjusting module 103 adjusts a first gamma voltage based on the first compensation value for improving a brightness uniformity of each pixel region.

In the third embodiment, the brightness acquiring module 101, the first compensation calculating module 102, and the gamma voltage adjusting module 103 are used for implementing the steps of the display brightness adjusting method of the first embodiment.

In accordance with the above, the display brightness adjusting device 10 acquires the first compensation value based on the acquired brightness distribution information, and adjusts the first gamma voltage based on the first compensation value for adjusting the brightness uniformity of each pixel region. Thus, a performance of the display apparatus is improved, and the problems of the non-uniform brightness in the related art caused by the designed structure of the display apparatus are avoided.

The display brightness adjusting device 10 further includes a backlight luminance adjusting module 104.

The backlight luminance adjusting module 104 increases a luminance of each light element in the backlight module when the lowest grayscale value is less than the second reference grayscale.

If the lowest grayscale value is less than the second reference grayscale, the adjusted uniformed brightness of the display apparatus does not satisfy the display requirement, and the luminance of each light element in the backlight module is increased by the backlight luminance adjusting module 104 for improving the brightness of the display apparatus. Thus, both the brightness uniformity and the brightness of the display apparatus are improved.

Fourth Embodiment

The display brightness adjusting device 10 further includes a color distribution acquiring module 105 and a second compensation calculating module 106.

The color distribution acquiring module 105 acquires color distribution information of each sub-pixel of the display apparatus.

The second compensation calculating module 106 analyzes the color distribution information to acquire a second compensation value for each pixel region.

In the fourth embodiment, the distribution acquiring module 105 and the second compensation calculating module 106 are used for implementing the steps of the display brightness adjusting method of the second embodiment.

The display brightness adjusting device 10 can adjust the brightness uniformity and the color uniformity of the display apparatus. Thus, the performance of the display apparatus is improved, and is inclined to the blue light, and the problems of the non-uniformed brightness in the related art caused by the designed structure of the display apparatus are avoided.

Fifth Embodiment

The present disclosure also provided a display apparatus 1. The display apparatus 1 includes the display brightness adjusting device 10 of the third embodiment or the fourth embodiment. The display brightness adjusting device 10 can adjust the brightness uniformity, and also can adjust the color uniformity of the display apparatus. Thus, the performance of the display apparatus is improved, and the problems of the non-uniform brightness in the related art caused by the designed structure of the display apparatus are avoided.

While various and preferred embodiments have been described the disclosure is not limited thereto. On the contrary, various modifications and similar arrangements (as would be apparent to those skilled in the art) are also intended to be covered. Therefore, the scope of the appended claims should be accorded the broadest interpretation so as to encompass all such modifications and similar arrangements.

What is claimed is:

1. A display brightness adjusting method for improving a brightness uniformity of a display apparatus having a plurality of pixel regions, comprising:

detecting a brightness of each pixel region to acquire a brightness distribution information;

analyzing the brightness distribution information to acquire a first compensation value for each pixel region; and adjusting a first gamma voltage of a corresponding pixel region based on the first compensation value;

wherein the step of analyzing the brightness distribution information to acquire a first compensation value for each pixel region comprises:

determining whether a lowest grayscale value of the detected grayscale values is larger than a first reference grayscale; the first reference grayscale is a lowest acceptable grayscale value of the display apparatus due to a display requirement;

when the lowest grayscale value is larger than the first reference grayscale, calculating the first compensation value based on the lowest grayscale value; the first compensation value comprising a difference between the lowest grayscale value and each detected grayscale value of each pixel region as the first compensation value for each pixel region; and when the lowest grayscale value is less than the first reference grayscale, calculating the first compensation value based on the first reference grayscale; the first compensation value comprising a difference between the first reference grayscale and each detected grayscale value as the first compensation value for each pixel region.

2. The display brightness adjusting method of claim 1, further comprising:

determining whether the lowest grayscale value is larger than a second reference grayscale; the second reference grayscale is a grayscale value close to a highest grayscale of the display; and when the lowest grayscale value is less than the second reference grayscale, determining whether a lowest grayscale value of the detected grayscale values is larger than a first reference grayscale; the first reference grayscale is a lowest acceptable grayscale value of the display apparatus due to a display requirement.

3. The display brightness adjusting method of claim 2, wherein the second reference grayscale is larger than the first reference grayscale.

4. The display brightness adjusting method of claim 2, wherein the display apparatus further including a backlight module, and further comprising:

increasing a luminance of each light element in the backlight module when the lowest grayscale value is less than the second reference grayscale.

5. The display brightness adjusting method of claim 1, wherein a first grayscale set and a second grayscale set are defined; grayscale values in the first grayscale set and the second grayscale set are continuous value; a highest grayscale value of the first grayscale set is less than a lowest grayscale value of the second grayscale set; a second gamma voltage is defined as the adjusted first gamma voltage; each grayscale value in the first grayscale set has a corresponding first gamma voltage, and each grayscale value in the second grayscale set has a corresponding second gamma voltage.

6. The display brightness adjusting method of claim 1, further comprising:

acquiring color distribution information of each pixel region of the display apparatus before analyzing the brightness distribution information to acquire a first compensation value for each pixel region.

7. The display brightness adjusting method of claim 6, further comprising:

after analyzing the brightness distribution information to acquire a first compensation value for each pixel region, analyzing the color distribution information to acquire a second compensation value for each pixel region.

8. The display brightness adjusting method of claim 7, wherein the first gamma voltage of each pixel region is adjusted based on the first compensation value and the second compensation value.

9. A display brightness adjusting device in a display apparatus having a plurality of pixel regions, the display brightness adjusting device comprising:

a brightness acquiring module configured to detect a brightness of each pixel region and acquire a brightness distribution information;

a first compensation calculating module configured to analyze the brightness distribution information and acquire a first compensation value for each pixel region, and a first gamma voltage adjusting module configured to adjust a first gamma voltage of a corresponding pixel region based on the first compensation value;

wherein the brightness distribution information comprises a detected grayscale value of each pixel region; the first compensation calculating module further determines whether a lowest grayscale value of the detected grayscale values is larger than a first reference grayscale; the first reference grayscale is a lowest acceptable grayscale value of the display apparatus due to a display requirement; when the lowest grayscale value is larger than the first reference grayscale, the first compensation calculating module calculates the first compensation value based on the lowest grayscale value; the first compensation value comprises a difference between the lowest grayscale value and each detected grayscale value of each pixel region as the first compensation value for each pixel region; when the lowest grayscale value is less than the first reference grayscale, the first compensation calculating module calculates the first compensation value based on the first reference grayscale; the first compensation value comprises a difference between the first reference grayscale and each detected grayscale value of each pixel region as the first compensation value for each pixel region.

10. The display brightness adjusting device of claim 9, wherein the first compensation calculating module further determines whether the lowest grayscale value is larger than a second reference grayscale; the second reference grayscale is a grayscale value close to a highest grayscale value of the display apparatus; when the lowest grayscale value is less than the second reference grayscale, the first compensation calculating module determines the lowest grayscale value is larger than the first reference grayscale.

11. The display brightness adjusting device of claim 10, wherein the second reference grayscale is larger than the first reference grayscale.

12. The display brightness adjusting device of claim 10, wherein the display apparatus further including a backlight module; the display brightness adjusting device further comprises a backlight luminance adjusting module; the backlight luminance adjusting module increases a luminance of each light element in the backlight module when the lowest grayscale value is less than the second reference grayscale.

13. The display brightness adjusting device of claim 9, wherein a first grayscale set and a second grayscale set are defined; grayscale values in the first grayscale set and the second grayscale set are continuous; a highest grayscale of the first grayscale set is less than a lowest grayscale value of the second grayscale set; a second gamma voltage is defined as the adjusted first gamma voltage; each grayscale value in the first grayscale set has a corresponding first gamma voltage, and each grayscale value in the second grayscale set has a corresponding second gamma voltage.

14. The display brightness adjusting device of claim 9, wherein the display brightness adjusting device further comprises a color distribution acquiring module and a second compensation calculating module; the color distribution acquiring module acquires color distribution information of each sub-pixel of the display apparatus; the second compensation calculating module analyzes the color distribution information to acquire a second compensation value for each pixel region.

15. The display brightness adjusting device of claim 14, wherein the first gamma voltage of each pixel region is adjusted based on the first compensation value and the second compensation value.

16. A display apparatus comprising:

a brightness acquiring module configured to detect a brightness of each pixel region and acquire a brightness distribution information;

a first compensation calculating module configured to analyze the brightness distribution information and acquire a first compensation value for each pixel region, and a first gamma voltage adjusting module configured to adjust a first gamma voltage of a corresponding pixel region based on the first compensation value to improve a brightness uniformity of each pixel region;

wherein the brightness distribution information comprises a detected grayscale value of each pixel region; the first compensation calculating module further determines whether a lowest grayscale value of the detected grayscale values is larger than a first reference grayscale; the first reference grayscale is a lowest acceptable grayscale of the display apparatus due to a display requirement when the lowest grayscale value is larger than the first reference grayscale, the first compensation calculating module calculates the first compensation value based on the lowest grayscale value; the first compensation value comprises a difference between the lowest grayscale value and each detected grayscale value of each pixel region as the first compensation value for each pixel region; when the lowest grayscale value is less than the first reference grayscale, the first compensation calculating module calculates the first compensation value based on the first reference grayscale; the first compensation value comprises a difference between the first reference grayscale and each detected grayscale value of each pixel region as the first compensation value for each pixel region.

17. The display apparatus of claim 16, wherein the first compensation calculating module further determines whether the lowest grayscale value is larger than a second reference grayscale; the second reference grayscale is a grayscale value close to a highest grayscale value of the display apparatus; when the lowest grayscale value is less than the second reference grayscale, the first compensation calculating module determines the lowest grayscale value is larger than the first reference grayscale; the second reference grayscale is larger than the first reference grayscale.

* * * * *